US008066543B2

(12) United States Patent
Kitamura et al.

(10) Patent No.: US 8,066,543 B2
(45) Date of Patent: Nov. 29, 2011

(54) TOY TOP PLAYING APPARATUS

(75) Inventors: Teruo Kitamura, Tokyo (JP); Haruhisa Ujita, Tokyo (JP); Nobuo Kobayashi, Tokyo (JP); Hiroaki Fujimaki, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 414 days.

(21) Appl. No.: 12/285,873

(22) Filed: Oct. 15, 2008

(65) Prior Publication Data

US 2009/0253343 A1 Oct. 8, 2009

(30) Foreign Application Priority Data

Apr. 8, 2008 (JP) ..... 2008-100783

(51) Int. Cl.
*A63H 1/00* (2006.01)

(52) U.S. Cl. ..... 446/256; 446/259; 446/236; 273/110; 273/242; 273/309; 273/441; 273/454; 473/570

(58) Field of Classification Search ..... 273/242, 273/110, 109, 129 V, 142 R, 309, 441, 445–446, 273/454, 460, 127 D; 446/233–235, 236–238; 473/570, 595; *A63H 1/00; A63F 9/00*
See application file for complete search history.

(56) References Cited

U.S. PATENT DOCUMENTS 1,130,461 A * 3/1915 Zolper ..... 273/109
1,552,530 A * 9/1925 Woods ..... 273/108.1
2,083,119 A * 6/1937 Hense ..... 273/119 R
3,091,464 A * 5/1963 Birdsall et al. ..... 273/108
3,335,519 A * 8/1967 Elward ..... 446/264
3,712,619 A 1/1973 Goldfarb et al.
3,754,759 A * 8/1973 Breslow et al. ..... 273/440
3,870,308 A * 3/1975 Reilly ..... 273/126 A
4,061,334 A * 12/1977 Kanno ..... 273/126 A
4,248,426 A 2/1981 Sims et al.
4,292,756 A * 10/1981 Jaworski et al. ..... 446/246
4,667,956 A * 5/1987 Davis ..... 273/447
4,828,258 A * 5/1989 Gebert ..... 273/456
4,856,790 A * 8/1989 Camillo ..... 273/317
4,982,961 A * 1/1991 Ichimura ..... 273/109
5,518,437 A 5/1996 Nonaka et al.

(Continued)

FOREIGN PATENT DOCUMENTS

CN 2604212 2/2004

(Continued)

OTHER PUBLICATIONS

Extended European Search Report mailed Jul. 16, 2009 in European Application No. 08253257.3-2318.

(Continued)

*Primary Examiner* — Gene Kim
*Assistant Examiner* — Matthew B Stanczak
(74) *Attorney, Agent, or Firm* — Staas & Halsey LLP

(57) ABSTRACT

A toy top playing apparatus for one person to play a toy top spinning game. A main body of the apparatus is provided with a display portion for displaying a game point, a play stage for spinning a toy top thereon, a dummy toy top simulating a toy top and arranged on the play stage, a sensor for detecting contact between the toy top and the dummy toy top, and a control section for processing the game point displayed on the display portion when the sensor detects the contact. The dummy toy top rotates on its axis, and a rotational direction thereof is controlled.

23 Claims, 5 Drawing Sheets

U.S. PATENT DOCUMENTS

| | | | | |
|---|---|---|---|---|
| 5,730,441 | A * | 3/1998 | Gibbons et al. | 273/118 D |
| 6,626,729 | B2 | 9/2003 | Osawa | |
| 6,739,939 | B2 | 5/2004 | Matsukawa | |
| 6,743,070 | B1 | 6/2004 | Lin | |
| 6,905,389 | B2 | 6/2005 | Matsukawa | |
| 7,063,589 | B2 | 6/2006 | Matsukawa et al. | |
| 7,427,225 | B2 | 9/2008 | Matsukawa et al. | |
| 2007/0021029 | A1 * | 1/2007 | Weidetz et al. | 446/256 |

FOREIGN PATENT DOCUMENTS

| | | |
|---|---|---|
| EP | 0 077 438 | 4/1983 |
| GB | 13390 | 0/1911 |
| JP | 3082469 | 12/2001 |
| JP | 2005-328976 | 12/2005 |
| WO | 97/25118 | 7/1997 |

OTHER PUBLICATIONS

Chinese Search Report issued Oct. 31, 2008 in Hong Kong Application No. 08109335.7 (5 pages) (English Translation 4 pages).
English Abstract of WIPO 97-25118, Published Jul. 17, 1997.
Specimen filed in U.S. Trademark Registration No. 2,709,995 on Nov. 12, 2002.
Apr. 28, 2009 Office Action in co-pending U.S. Design U.S. Appl. No. 29/309,769.
Apr. 28, 2009 Office Action in co-pending U.S. Design U.S. Appl. No. 29/311,061.
U.S. Appl. No. 29/309,769, filed Oct. 6, 2008, Ujita, TOMY Company, Ltd.
U.S. Appl. No. 29/311,061, filed Dec. 17, 2008, Ujita, TOMY Company, Ltd.

* cited by examiner

TOY TOP PLAYING APPARATUS

CROSS REFERENCE TO RELATED APPLICATION

This application claims the benefit under 35 U.S.C. Section 119 of Japanese Patent Application No. 2008-100783, filed Apr. 8, 2008, which is hereby incorporated by reference in its entirety into this application.

BACKGROUND OF THE INVENTION

1. Field of the Invention

This invention relates to a toy top playing apparatus, and more particularly to a toy top playing apparatus by which a player can play a toy top spinning game by himself/herself by spinning a toy top.

2. Description of the Related Art

Conventionally, there has been proposed a toy top playing table for spinning toy tops thereon so as to play a game, which can let players optionally select attacking or taking shelter by forcibly bringing a toy top into contact with a toy top of an opponent or moving the toy top away from the toy top of the opponent, so that a battle game using the toy tops is rendered exciting (see, for example, Japanese Utility Model No. 3082469). The toy top playing table is used at a time when the toy top is battling against the other toy top, and is structured such that a mounting table portion is arranged in a top surface of the play table, a top surface of a mounting plate mounting the toy top is arranged in a large circular opening formed in the center of the mounting table portion in such a manner as to be exposed, and the mounting plate can be rotated backward and forward by pushing and pulling a slide member.

The toy top playing table described above is structured such that an intention of the player can be reflected in the manner of battling, and an exciting game can be played. However, an opposing player is always necessary, and thus there has been a problem that only one person can not play the toy top spinning game.

SUMMARY OF THE INVENTION

The present invention has been made in view of the problem mentioned above. Accordingly, it is an object of the present invention to provide a toy top playing apparatus wherein one person can play a toy top spinning game by spinning an actual toy top by oneself, even if there is no opposing player.

There is provided a toy top playing apparatus by which one person is capable of playing a toy top spinning game. The apparatus includes: a main body; a play stage provided in the main body for spinning a toy top thereon; and a dummy toy top simulating a toy top and arranged on the play stage; wherein the dummy toy top rotates on its axis, and a rotational direction thereof is controlled in one direction or in a bidirectional way.

The toy top playing apparatus may be structured such that the play stage includes a circular movable stage which turns around its center, the dummy toy top is arranged on the movable stage so as to be close to an outer periphery thereof, and the dummy toy top turns around the center of the movable stage while rotating on its own axis in accordance with a rotation of the movable stage.

Further, the toy top playing apparatus may be structured such that the main body is provided with a display portion for displaying a game point, the dummy toy top is provided with a sensor for detecting a contact of the toy top with the dummy toy top, and a control section is provided so as to process the game point displayed on the display portion when the sensor detects the fact that the toy top comes into contact with the dummy toy top.

Further, the toy top playing apparatus is preferably structured such that a plurality of fences is arranged on an outer side of the play stage so as to be spaced at predetermined intervals, each of the fences is provided with another sensor for detecting the contact of the toy top with the fence, the control section stores the fact that the toy top has come into contact with the fence when the other sensor detects the fact that the toy top comes into contact with the fence, and reflects whether or not the toy top comes into contact with the fence in processing the game point, on the basis of the memory when the toy top comes into contact with the dummy toy top, and the control section deletes the memory that the toy top has come into contact with the fence, when the control section completes the processing of the game point on the basis of the fact that the toy top comes into contact with the dummy toy top.

Further, the toy top playing apparatus can be structured such that an outer side of the play stage is provided with a field for receiving the toy top which jumps out of or leaves the play stage, the field is provided with a sensor for detecting the fact that the toy top enters the field, and the control section forcibly finishes the game when the sensor detects that the toy top enters the field.

Further, the main body may be provided with a timer means for monitoring a time of the game and forcibly finishing the game when a predetermined time has passed after the start of the game.

Since the dummy toy top simulating the toy top is arranged on the play stage, and the dummy toy top rotates on its axis, it is possible to play a toy top spinning game against the dummy toy top, and thus it is possible for only one person to play by himself/herself, even if there is no opposing player.

In accordance with one embodiment of the present invention, since the dummy toy top is arranged on the movable stage turning on the play stage, and the dummy toy top is disposed close to the outer periphery of the movable stage, the dummy toy top turns around the center of the movable stage while rotating on its own axis, and thus comes close to imitating an actual motion of the toy top, and thus it is possible to enjoy a toy top spinning game which is more like the actual one.

In accordance with one embodiment of the present invention, since the sensor is provided to detect the fact that the toy top of the user comes into contact with the dummy toy top, it is possible to reflect the fact of the contact in the game point, and it is possible to play the toy top spinning game with the dummy toy top. Accordingly, there can be provided a new type of toy top playing apparatus by which a game in a virtual space generated by a display game machine can be enjoyed in the real world.

In accordance with one embodiment of the present invention, since the fences are provided in the periphery of the play stage so as to be spaced at the predetermined intervals, and each of the fences is provided with a sensor for detecting the fact that the toy top comes into contact with the fence, it is possible to determine the contact of the toy top with the fence if the sensor is operated, and it is possible to store the fact that the toy top has come into contact with the fence so as to reflect the fact in the game point when the toy top comes into contact with the dummy toy top. Accordingly, the player would construct a certain toy top having such a durability as not to be damaged, even if the toy top comes into contact with the fence, and having such a high power as to come into contact with the fence(s) repeatedly, and thus the player can get ready for an actual battle with the other toy top.

In accordance with one embodiment of the present invention, since the periphery of the play stage is provided with the field for receiving the toy top which leaves the play stage without coming into contact with the fences, and the field is provided with the sensor for detecting the fact that the toy top enters the field, the game is forcibly finished when the toy top enters the field. Accordingly, the playing apparatus does not go on operating endlessly even if there is generated a state in which the game can not be played, and it is possible to quickly start the next game.

In accordance with one embodiment of the present invention, the control section monitors the game time on the basis of a timer. It is thus possible to prevent the game being carried on in a state where the actual game is finished due to spinning of the toy top being stopped, and it is possible to provide such an environment that the game can be carried out in sequence.

DESCRIPTION OF THE EMBODIMENTS

Figure 1:
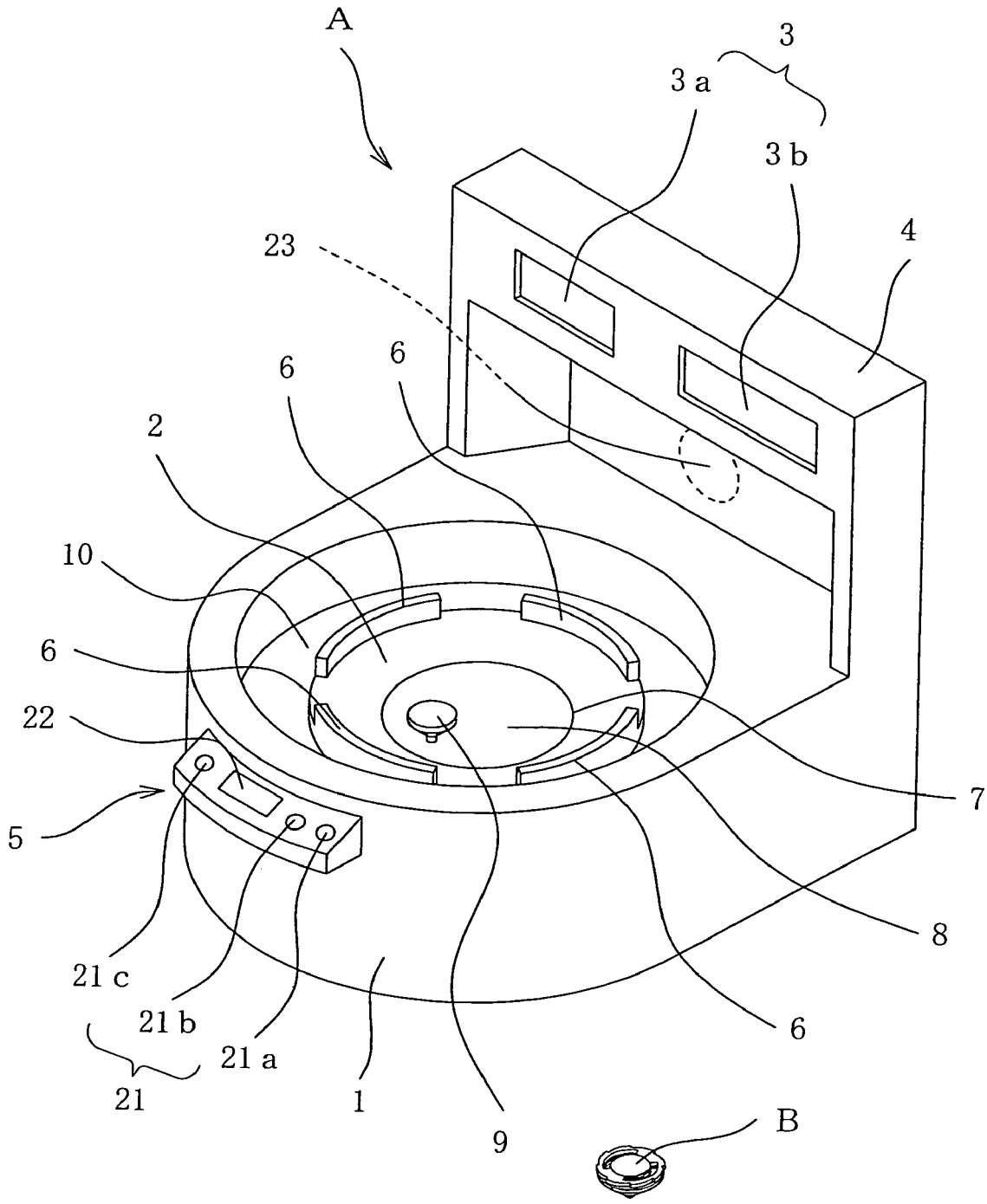
FIG. 1 is a perspective view showing an embodiment of a toy top playing apparatus in accordance with the present invention.
Figure 2:
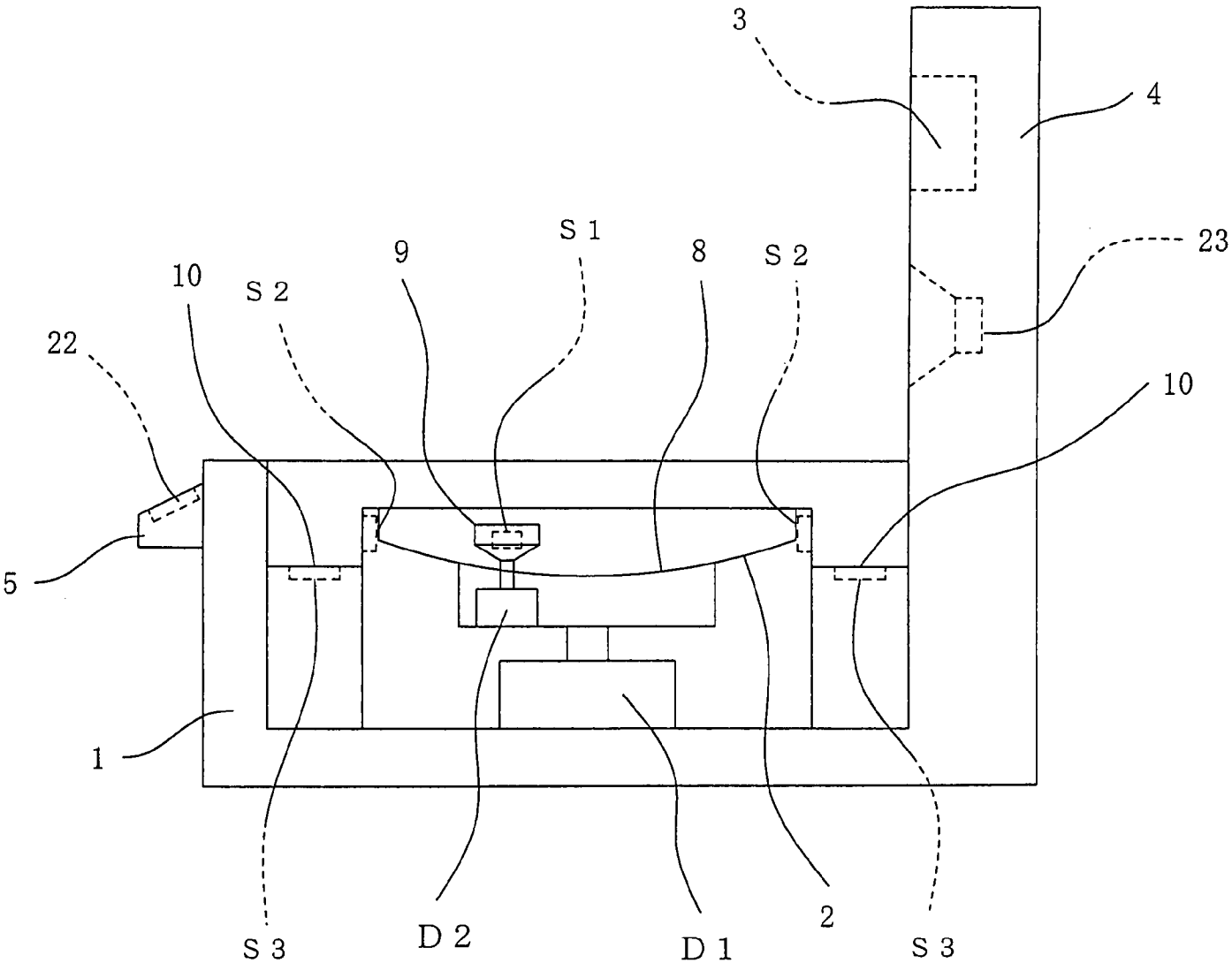
FIG. 2 is a schematic view showing an inner structure of the toy top playing apparatus.

FIG. 1 shows an embodiment of a toy top playing apparatus in accordance with the present invention, which toy top playing apparatus (hereinafter, referred to as a playing apparatus) A includes a main body which is provided with a play stage 2 for spinning a toy top B thereon in the center of a base 1, vertically provided in a rear portion thereof with a panel 4 in which a display portion 3 for displaying a point of a game and a remaining time of the game is arranged, and provided with an operation panel 5 in the front of the base 1.

The play stage 2 is formed with a shallow bowl shape in which the center is curved downward, and a plurality of fences 6 is vertically provided in the periphery of the play stage 2 so as to be spaced at predetermined intervals. The fences 6 are structured so as to prevent the toy top B shot onto the play stage 2 from jumping out of the play stage 2. However, spaces are provided between the fences 6 so that the toy top B which does not come into contact with the fences 6 leaves the play stage 2.

Further, a circular opening 7 is provided in the center of the play stage 2, and a disc-like movable stage 8 is arranged in the opening 7. The movable stage 8 is structured so as to be turned around its center by a drive apparatus D1 arranged within the main body.

The drive apparatus D1 may be structured so as to actuate a drive mechanism (not shown) by using a second motor 25 described below as a driving force so as to turn the movable stage 8.

A dummy toy top 9 is arranged at a position close to an outer periphery of the movable stage 8 which is deviated from the center thereof. The dummy toy top 9 is formed so as to simulate the toy top, and is structured so as to be rotated on its axis by a drive apparatus D2 arranged below the movable stage 8. Thus, the dummy toy top 9 is structured so as to turn around the center of the movable stage 8 while rotating on its own axis upon the rotation of the movable stage 8.

The drive apparatus D2 may be also structured so as to actuate a drive mechanism (not shown) by using a first motor 24 described below as a driving force so as to rotate the dummy toy top 9 on its axis.

In the illustrated embodiment, the drive apparatus D2 is structured so as to be capable of changing the rotational direction of the dummy toy top 9 between forward and backward. This can be achieved by a control of the forward and backward rotation of the first motor 24 by a control section 20 described below.

Further, the periphery of the play stage 2 is provided circumferentially with a field 10 for receiving the toy top B which leaves the play stage 2 without coming into contact with the fences 6 so as to enter the field 10.

In this case, the dummy toy top 9 and the fences 6 are respectively provided with sensors S1 and S2 (hereinafter, referred to as a first sensor S1 and a second sensor S2) for detecting the contact of the toy top B with the dummy toy top 9 and one of the fences 6, respectively, and the field 10 is provided with a sensor S3 (hereinafter, referred to as a third sensor S3) for detecting the fact that the toy top B enters the field 10.

Figure 3:
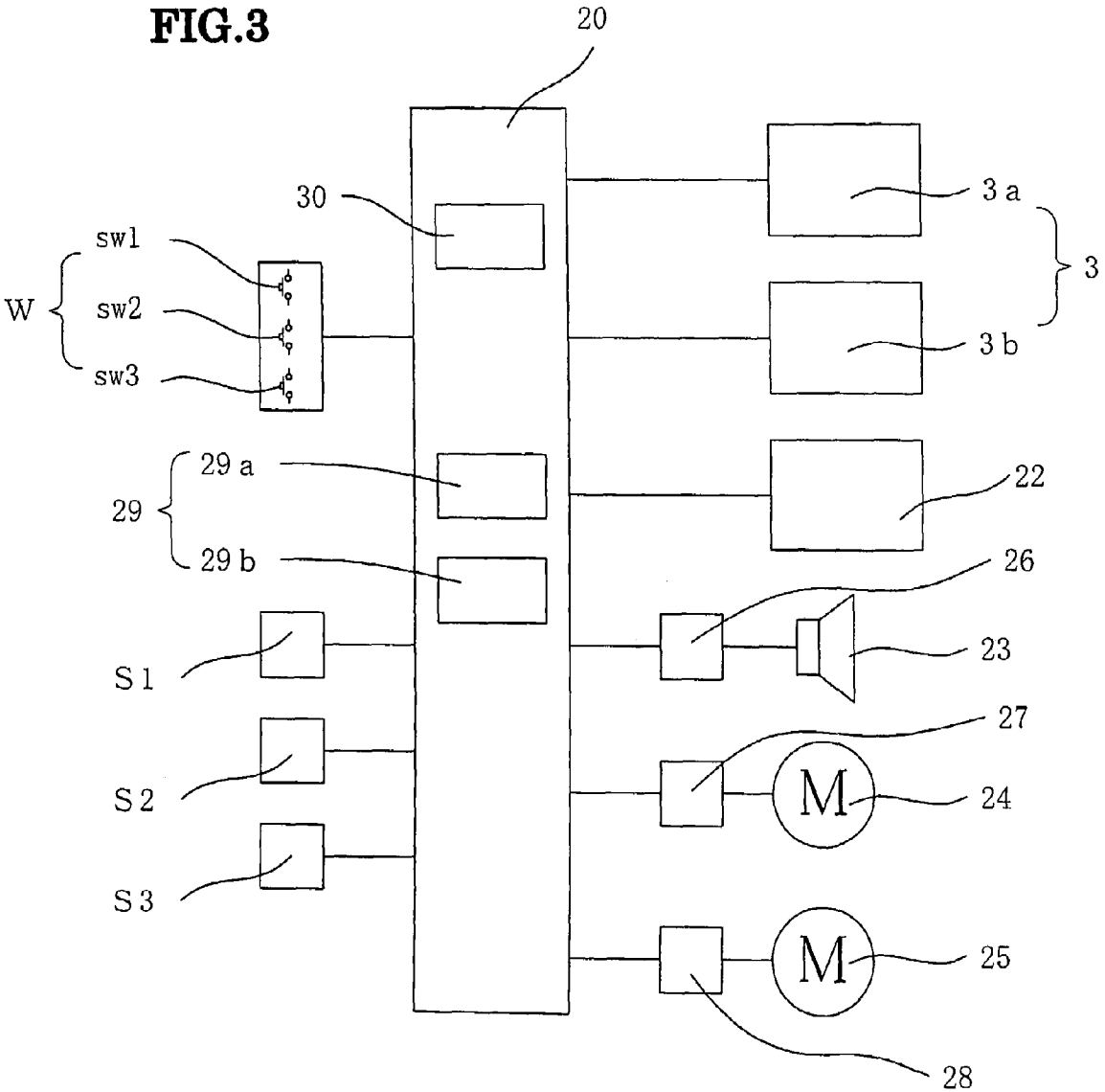
FIG. 3 is a block diagram of the toy top playing apparatus.

FIG. 3 is a block diagram showing an electronic structure of the playing apparatus A described above. The control section 20 controls the whole of the playing apparatus A in accordance with a control program stored in a built-in memory. The control section 20 may include a programmable voice synthesis integrated circuit ("IC"). To the control section 20, there are connected the first sensor S1 for sensing the fact that the toy top B comes into contact with the dummy toy top 9, the second sensor S2 for sensing the fact that the toy top B comes into contact with one of the fences 6, the third sensor S3 for sensing the fact that the toy top B enters the field 10 from the play stage 2, as mentioned above, and switches SW (sw1, sw2 and sw3) corresponding to operation buttons 21 (a selection button 21*a*, a decision button 21*b* and a start button 21*c*) arranged in the operation panel 5, and connected to the control section 20 are a timer display portion 3*a* for displaying a remaining time of the game, a point display portion 3*b* for displaying a game point, a liquid crystal display 22 arranged in the operation panel 5, a speaker 23 for outputting a sound effect, the first motor 24 for rotating the dummy toy top 9, and the second motor 25 for turning the movable stage 8.

In FIG. 3, reference numeral 26 denotes an amplifier circuit, reference numerals 27 and 28 each denote a motor drive circuit, reference numeral 29 denotes a counter (a game point counter 29*a* and a hit point counter 29*b*) built-in the control section 20, and reference numeral 30 denotes a timer counter.

The game point counter 29*a* is programmed such that a predetermined game point GP is set at a time of starting the game, and a hit point HP is subtracted from the game point GP when the toy top B comes into contact with the dummy toy top 9 as sensed by the first sensor S1. Further, the game point counter 29*a* is programmed such that whenever the toy top B comes into contact with one of the fences 6 (as sensed by sensor S2) before coming into contact with the dummy toy top 9, a predetermined point $\alpha$ is added to the hit point HP, and the thus increased hit point HP is subtracted from the game point GP, when the toy top B comes into contact with the dummy toy top 9 after coming into contact with one or more of the fences 6.

Figure 4:
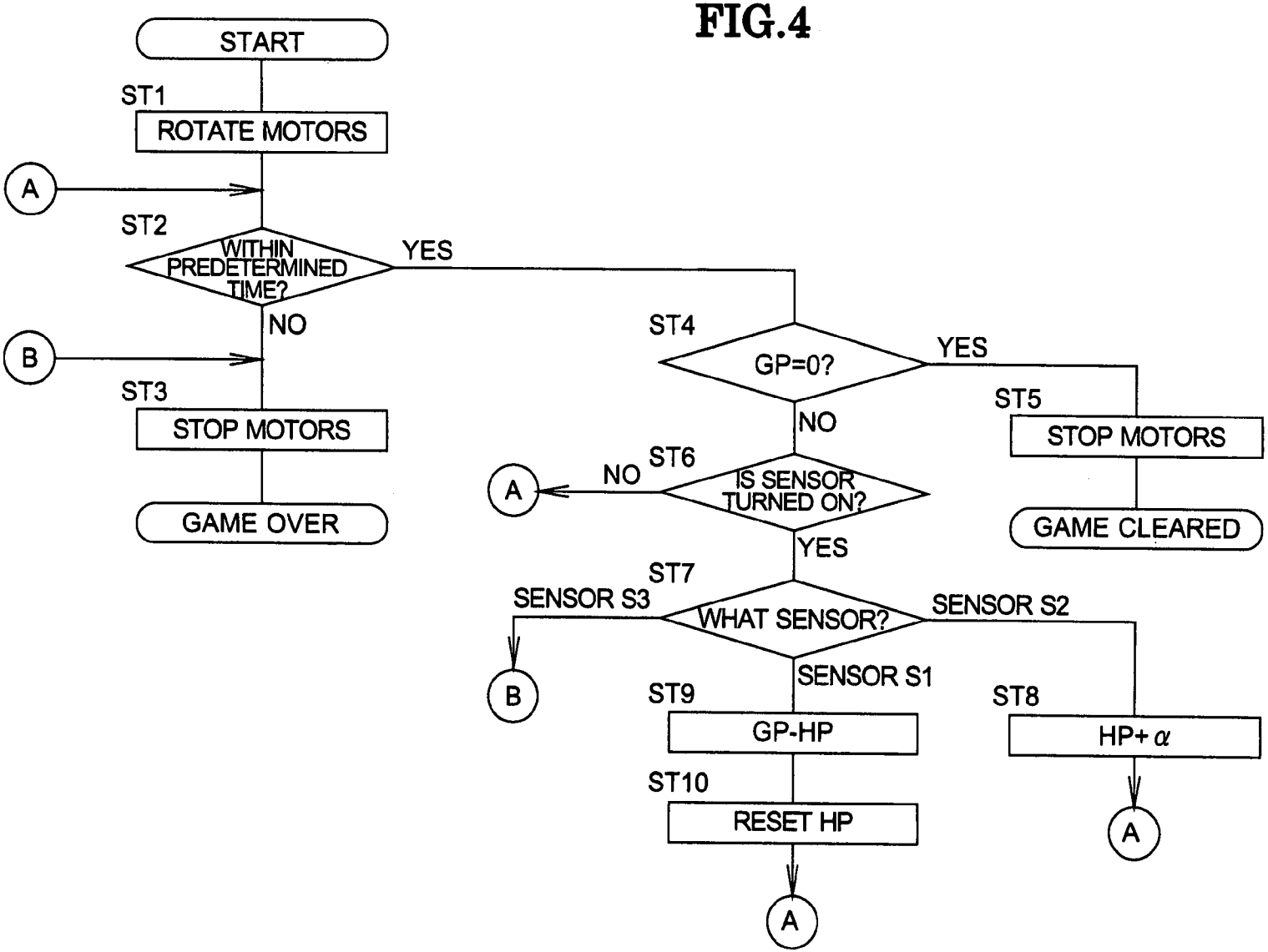
FIG. 4 is a flowchart showing an operating mode of the toy top playing apparatus.

Next, a description will be given of a manner of using the playing apparatus A having the structure described above on the basis of a flowchart in FIG. 4. When a power supply is turned on, the remaining time (a count value of the timer counter 30) is displayed on the timer display portion 3*a* and the game point GP at a time of starting is displayed on the point display portion 3*b*. The operation buttons 21 are pushed in accordance with the display on the liquid crystal display 22 of the operation panel 5. More particularly, a condition (for example, whether the dummy toy top 9 is rotated forward or the dummy toy top 9 is rotated forward and backward, a level of a power of the dummy toy top generated by setting whether or not the rotation of the dummy toy top is fast or slow, amount of the game point at a time of starting, and the like) of the game is selected by pushing the selection button 21*a*, setting the condition by pushing the decision button 21*b*, and then pushing the start button 21*c*.

When the start button 21*c* is pushed, a countdown of the timer counter 30 is started and the motors 24 and 25 rotate, and thus the dummy toy top 9 starts rotating on its axis and the movable stage 8 starts turning (step ST1).

The player sets the toy top B in a known toy top shooting device or spinner (not shown), and operates the shooting device so as to shoot the toy top B onto the play stage 2. The toy top B shot onto the play stage 2 moves while spinning on the play stage 2.

The control section 20 controls whether or not to stop the rotation of the motors 24 and 25 while determining whether or not the toy top B comes into contact with the fences 6, whether or not the toy top B comes into contact with the dummy toy top 9, whether or not the toy top B enters the field 10 from the play stage 2, or whether or not the game time is finished.

The process goes to step ST2, and determines on the basis of the count value of the timer counter 30 whether or not an elapsed time of the game is within a predetermined time. If the predetermined time has passed (the count value of the timer counter 30 is zero), the process goes to step ST3 so as to stop the motors 24 and 25 and finish the game, and if the count value of the timer counter 30 does not become zero, the process determines that the time is within the predetermined time, and goes to step ST4 so as to determine whether or not the game point GP becomes zero.

If the game point GP becomes zero, the process determines that the game can be cleared, and goes to step ST5 so as to display a message such as game cleared or the like on the liquid crystal display 22, output a fanfare or the like celebrating winning the game from the speaker 23 and stop the motor, to thereby clear the game.

If the game point GP does not become zero, the process goes to step ST6 so as to determine whether or not any one of the sensors S1, S2 and S3 is turned on, and if none of them is turned on, the process goes back to step ST2 so as to monitor the elapsed time of the game on the basis of the count value of the timer counter 30, and if the time is within the predetermined time, the turn-on of any one of the sensors S1, S2 and S3 is waited for.

In the case where in step ST6 it is determined that the sensor is turned on, the process goes to step ST7 so as to determine what sensor is turned on.

Figure 5A:
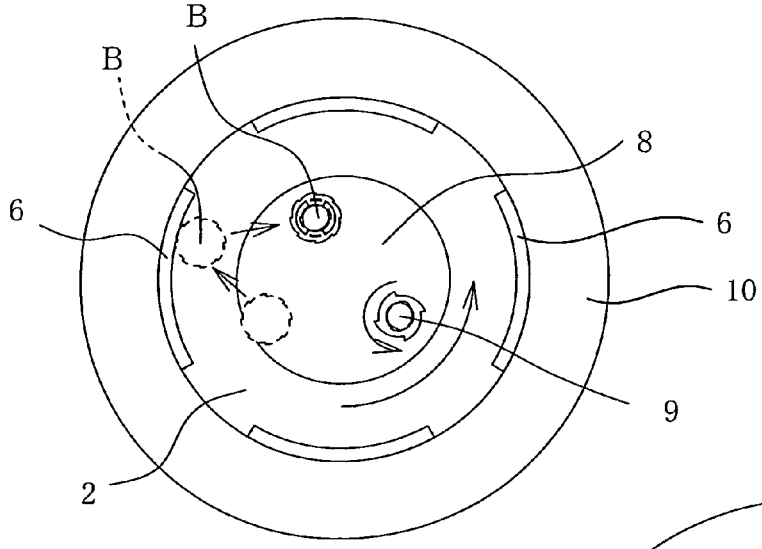
FIGS. 5A to 5C are plan views showing a relation between a toy top and a dummy toy top on a play stage.

If the turned-on sensor is determined to be the second sensor S2 in step ST7, the control section 20 determines as shown in FIG. 5A that the toy top B comes into contact with one of the fences 6, and the process goes to step ST8 so as to add a point a (for example, one point) to the hit point HP and store it, and thereafter the process goes back to step ST2 so as to wait for any one of the sensors to be turned on again. In the case where the toy top B sequentially comes into contact with a plurality of the fences 6, the process repeats step ST2, step ST4, step ST6, step ST7 and step ST8, and the hit point HP is increased.

Figure 5B:
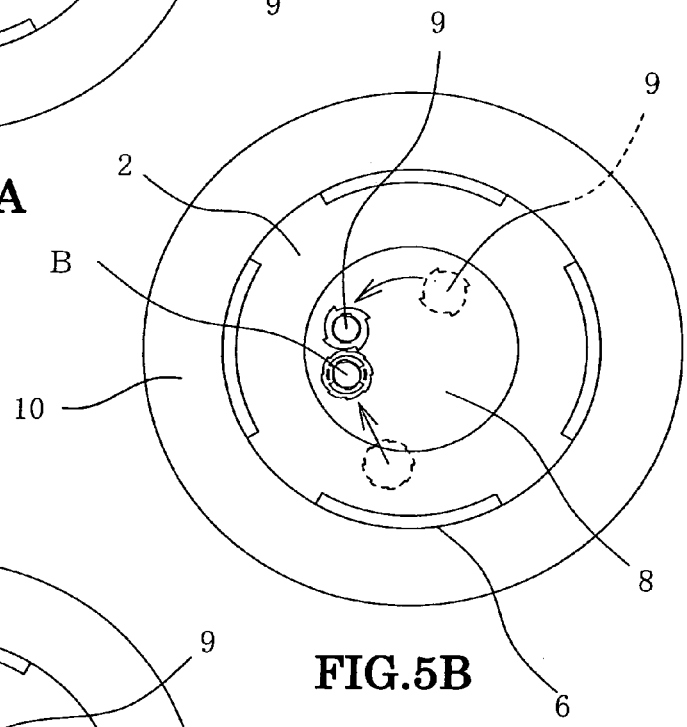

If the turned-on sensor is determined to be the first sensor S1 in step ST7, the control section 20 determines as shown in FIG. 5B that the toy top B comes into contact with the dummy toy top 9, the process goes to step ST9 so as to subtract the hit point HP from the game point GP on the basis of the memory, the remaining game point GP is displayed on the display portion 3*b*, the process further goes to step ST10 so as to reset the hit point HP, the memory that the toy top B has come into contact with the fence 6 is deleted, and thereafter the process goes back to step ST2 so as to wait for any one of the sensors to be turned on again.

Figure 5C:
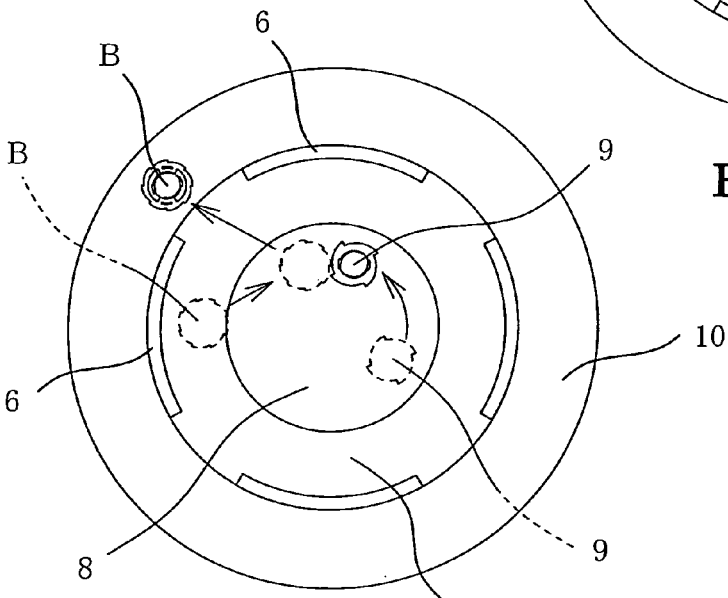

If the turned-on sensor is determined to be the third sensor S3 in step ST7, the control section 20 determines as shown in FIG. 5C that the toy top B is flipped by the dummy toy top 9 so as to enters the field 10 from the play stage 2 and the game can not be further carried on, and the process goes back to step ST3 so as to stop the motors 24 and 25 and forcibly finish the game.

As described above, the player can carry out the toy top spinning game by using the actual toy top and setting the dummy toy top 9 which rotates on the play stage 2 as the opponent. Further, it is possible to subtract the hit point HP which is increased depending on whether or not the toy top directly comes into contact with the dummy toy top 9, whether or not the toy top comes into contact with the dummy toy top 9 after having been bounced from the fence(s) 6, and the frequency which the toy top comes into contact with the fences 6, from the game point GP. Therefore, it is possible to prepare for the actual battle by incorporating some features in a structure of the toy top so as to efficiently make the game point GP zero, in addition to simply spinning the toy top on the play stage. Further, it is possible to construct the playing apparatus A by which only one person can play with the toy top while setting the dummy toy top 9 as the opponent.

Further, since the dummy toy top 9 turns around the center of the movable stage 8 while rotating on its own axis in correspondence to the rotation of the movable stage 8 rather than rotating at one position, the dummy toy top 9 moves while rotating on the play stage like the actual toy top. Accordingly, it is possible to carry out the actual battle-like toy top play.

The toy top playing apparatus A described above can be used in an amusement arcade or the like, in which case the apparatus is provided with the panel 4 in which the display portion 3 constituted by the timer display portion 3*a* for displaying the remaining time of the game and the point display portion 3*b* for displaying the point are arranged. Instead, this apparatus may be structured such that the main body 1 is provided simply with the play stage 2 for spinning the toy top thereon, and the dummy toy top 9 (of course, the movable stage 8 may also be provided) which simulates the toy top arranged on the play stage 2, and the rotation of the dummy toy top 9 is controlled in one direction or in a bidirectional way. Accordingly, it is possible to downsize the toy top playing apparatus A, and it is possible to provide the toy top playing apparatus A by which the toy top spinning game of battling the dummy toy top 9 with one's own toy top B can be done at home.

What is claimed is:

1. A toy top playing apparatus for playing a game, comprising:

a main body;

a play stage provided on the main body for spinning a toy top thereon;

a dummy toy top having a larger diameter proximate one end and a smaller diameter at another end, and being arranged on the play stage via a rotatable shaft coupled to the another end of the dummy toy top and geared to rotate on the play stage, in at least one direction, and wherein the play stage includes a circular movable stage which rotates around a center thereof; and the dummy toy top is arranged on the movable stage so as to be close to an outer periphery thereof, and the dummy toy top rotates around the center of the movable stage, while rotating on the shaft, in accordance with a rotation of the movable stage.

2. The toy top playing apparatus according to claim 1, further comprising:

a display portion provided on the main body for displaying a game point, wherein the dummy toy top is provided with a sensor for detecting a contact of the toy top with the dummy toy top, and a control section provided so as to process the game point displayed on the display portion, when the sensor detects the fact that the toy top comes into contact with the dummy toy top.

3. The toy top playing apparatus according to claim 2, further comprising a plurality of fences arranged on an outer side of the play stage so as to be spaced at predetermined intervals, wherein each of the fences is provided with a second sensor for detecting the contact of the toy top with one of the fences, the control section stores in a memory the fact that the toy top has come into contact with one of the fences, when the second sensor detects the fact that the toy top comes into contact with one of the fences, and determines whether or not the toy top comes into contact with one of the fences in processing the game point, on the basis of the memory, when the toy top comes into contact with the dummy toy top, and the control section deletes the memory that the toy top has come into contact with one of the fences, when the control section completes the processing of the game point on the basis of the fact that the toy top comes into contact with the dummy toy top.

4. The toy top playing apparatus according to claim 1, further comprising a field, provided on an outer side of the play stage, for receiving the toy top which leaves the play stage, wherein the field is provided with a sensor for detecting the fact that the toy top enters the field, and the game is finished when the field sensor detects that the toy top enters the field.

5. The toy top playing apparatus according to claim 2, further comprising a field, provided on an outer side of the play stage, for receiving the toy top which leaves the play stage, wherein the field is provided with a sensor for detecting the fact that the toy top enters the field, and the game is finished when the field sensor detects that the toy top enters the field.

6. The toy top playing apparatus according to claim 1, further comprising a timer, provided in the main body, for monitoring a time of the game and finishing the game when a predetermined time has passed after a start of the game.

7. The toy top playing apparatus according to claim 2, further comprising a timer, provided in the main body, for monitoring a time of the game and finishing the game when a predetermined time has passed after a start of the game.

8. The toy top playing apparatus according to claim 1, wherein the at least one direction is selected from forward and backward.

9. A toy top playing apparatus for playing a game, comprising:

a main body;

a play stage on the main body for spinning a toy top thereon, wherein the play stage includes a circular movable stage which rotates around a center thereof;

a dummy toy top, having a larger diameter proximate one end and a smaller diameter at another end, and being arranged on the play stage via a rotatable shaft coupled to the another end of the dummy toy top and geared to rotate on the play stage in at least one direction, a display portion provided on the main body for displaying a game point, wherein the dummy toy top is provided with a first sensor for detecting a contact of the toy top with the dummy toy top;

a control section to process the game point displayed on the display portion, when the first sensor detects contact between the toy top and the dummy toy top;

at least one fence arranged on the play stage, wherein the at least one fence is provided with a second sensor for detecting a contact of the toy top with the at least one fence, wherein the control section stores, in a memory, the fact that the toy top has come into contact with the at least one fence, when the second sensor detects the fact that the toy top comes into contact with the at least one fence, and determines whether or not the toy top comes into contact with the at least one fence in processing the game point, on the basis of the memory, when the toy top comes into contact with the dummy toy top, and wherein the control section deletes the memory that the toy top has come into contact with the at least one fence, when the control section completes the processing of the game point on the basis of the fact that the toy top comes into contact with the dummy toy top; and a field, provided peripherally of the play stage, for receiving the toy top which leaves the play stage, wherein the field is provided with a third sensor for detecting the fact that the toy top enters the field, and wherein the control section finishes the game when the third sensor detects that the toy top enters the field.

10. The toy top playing apparatus according to claim 9, further comprising a timer for monitoring a time of the game and finishing the game when a predetermined time has passed.

11. The toy top playing apparatus according to claim 9, wherein the at least one direction is selected from forward and backward.

12. A toy top playing apparatus for playing a game, comprising:

a main body;

a play stage provided on the main body for spinning a toy top thereon;

a dummy toy top having a larger diameter proximate one end and a smaller diameter at another end, and being arranged on the play stage via a rotatable shaft coupled to the another end of the dummy toy top and geared to rotate on the play stage in at least one direction;

a display portion provided on the main body for displaying a game point, wherein the dummy toy top is provided with a sensor for detecting a contact of the toy top with the dummy toy top; and a control section provided so as to process the game point displayed on the display portion, when the sensor detects the fact that the toy top comes into contact with the dummy toy top.

13. The toy top playing apparatus according to claim 12, wherein the play stage includes a circular movable stage which rotates around a center thereof, the dummy toy top is arranged on the movable stage so as to be close to an outer periphery thereof, and the dummy toy top rotates around the center of the movable stage, while rotating on the shaft, in accordance with a rotation of the movable stage.

14. The toy top playing apparatus according to claim 12, further comprising a plurality of fences arranged on an outer side of the play stage so as to be spaced at predetermined intervals, wherein each of the fences is provided with a second sensor for detecting a contact of the toy top with one of the fences, the control section stores in a memory the fact that the toy top has come into contact with one of the fences, when the second sensor detects the fact that the toy top comes into contact with one of the fences, and determines whether or not the toy top comes into contact with one of the fences in processing the game point, on the basis of the memory, when the toy top comes into contact with the dummy toy top, and the control section deletes the memory that the toy top has come into contact with one of the fences, when the control section completes the processing of the game point on the basis of the fact that the toy top comes into contact with the dummy toy top.

15. The toy top playing apparatus according to claim 12, further comprising a field, provided on an outer side of the play stage, for receiving the toy top which leaves the play stage, wherein the field is provided with a sensor for detecting the fact that the toy top enters the field, and the game is finished when the field sensor detects that the toy top enters the field.

16. The toy top playing apparatus according to claim 12, further comprising a timer, provided in the main body, for monitoring a time of the game and finishing the game when a predetermined time has passed after a start of the game.

17. The toy top playing apparatus according to claim 12, wherein the at least one direction is selected from forward and backward.

18. A toy top playing apparatus for playing a game, comprising:

a main body;

a play stage provided on the main body for spinning a toy top thereon;

a dummy toy top having a larger diameter proximate one end and a smaller diameter at another end, and being arranged on the play stage via a rotatable shaft coupled to the another end of the dummy toy top and geared to rotate on the play stage in at least one direction; and a field, provided on an outer side of the play stage, for receiving the toy top which leaves the play stage, wherein the field is provided with a sensor for detecting the fact that the toy top enters the field, and the game is finished when the field sensor detects that the toy top enters the field.

19. The toy top playing apparatus according to claim 18, wherein the play stage includes a circular movable stage which rotates around a center thereof, the dummy toy top is arranged on the movable stage so as to be close to an outer periphery thereof, and the dummy toy top rotates around the center of the movable stage, while rotating on the shaft, in accordance with a rotation of the movable stage.

20. The toy top playing apparatus according to claim 18, further comprising:

a display portion provided on the main body for displaying a game point, wherein the dummy toy top is provided with a sensor for detecting a contact of the toy top with the dummy toy top, and a control section provided so as to process the game point displayed on the display portion, when the dummy toy top sensor detects the fact that the toy top comes into contact with the dummy toy top.

21. The toy top playing apparatus according to claim 20, further comprising a plurality of fences arranged on an outer side of the play stage so as to be spaced at predetermined intervals, wherein each of the fences is provided with a sensor for detecting the contact of the toy top with one of the fences, the control section stores in a memory the fact that the toy top has come into contact with one of the fences, when the plurality of fences sensor detects the fact that the toy top comes into contact with one of the fences, and determines whether or not the toy top comes into contact with one of the fences in processing the game point, on the basis of the memory, when the toy top comes into contact with the dummy toy top, and the control section deletes the memory that the toy top has come into contact with one of the fences, when the control section completes the processing of the game point on the basis of the fact that the toy top comes into contact with the dummy toy top.

22. The toy top playing apparatus according to claim 18, further comprising a timer, provided in the main body, for monitoring a time of the game and finishing the game when a predetermined time has passed after a start of the game.

23. The toy top playing apparatus according to claim 18, wherein the at least one direction is selected from forward and backward.

* * * * *